US008875516B2

(12) United States Patent
Uhm et al.

(10) Patent No.: US 8,875,516 B2
(45) Date of Patent: Nov. 4, 2014

(54) TURBINE COMBUSTOR CONFIGURED FOR HIGH-FREQUENCY DYNAMICS MITIGATION AND RELATED METHOD

(75) Inventors: Jong Ho Uhm, Simpsonville, SC (US); Baifang Zuo, Simpsonville, SC (US); William David York, Greer, SC (US); Shivakumar Srinivasan, Greer, SC (US)

(73) Assignee: General Electric Company, Schenectady, NY (US)

( * ) Notice: Subject to any disclaimer, the term of this patent is extended or adjusted under 35 U.S.C. 154(b) by 945 days.

(21) Appl. No.: 13/021,298

(22) Filed: Feb. 4, 2011

(65) Prior Publication Data

US 2012/0198856 A1 Aug. 9, 2012

(51) Int. Cl.

| | |
|---|---|
| ***F23R 3/42*** | (2006.01) |
| ***F23D 14/62*** | (2006.01) |
| ***F23R 3/28*** | (2006.01) |
| ***F23R 3/10*** | (2006.01) |

(52) U.S. Cl.

CPC ..... *F23D 14/62* (2013.01); *F23R 2900/00014* (2013.01); *F23R 3/286* (2013.01); *F23R 2900/00002* (2013.01); *F23M 99/005* (2013.01); *F23R 3/10* (2013.01)

USPC ..... 60/725; 60/737; 60/747; 60/772

(58) Field of Classification Search

CPC ..... F23R 3/28; F23R 3/34; F23R 3/42; F23R 3/46; F02C 7/222; F02K 1/827

USPC ..... 60/772, 725, 737, 739, 747

See application file for complete search history.

(56) References Cited

U.S. PATENT DOCUMENTS

| | | | | |
|---|---|---|---|---|
| 3,041,836 | A * | 7/1962 | Truman et al. | 60/725 |
| 4,100,733 | A | 7/1978 | Striebel et al. | |
| 4,262,482 | A | 4/1981 | Roffe et al. | |
| 4,845,952 | A | 7/1989 | Beebe | |
| 4,966,001 | A | 10/1990 | Beebe | |
| 5,235,814 | A | 8/1993 | Leonard | |
| 5,263,325 | A | 11/1993 | McVey et al. | |
| 5,361,586 | A * | 11/1994 | McWhirter et al. | 60/737 |
| 5,927,076 | A | 7/1999 | Pillsbury | |
| 5,943,866 | A | 8/1999 | Lovett et al. | |
| 6,164,055 | A * | 12/2000 | Lovett et al. | 60/776 |
| 6,357,237 | B1 | 3/2002 | Candy et al. | |
| 6,536,216 | B2 | 3/2003 | Halila et al. | |
| 6,931,853 | B2 * | 8/2005 | Dawson | 60/725 |
| 6,983,600 | B1 | 1/2006 | Dinu et al. | |
| 7,003,958 | B2 | 2/2006 | Dinu et al. | |

(Continued)

OTHER PUBLICATIONS

U.S. Appl. No. 12/555,129, filed Sep. 8, 2009 (pending).

(Continued)

*Primary Examiner* — J. Gregory Pickett

(74) *Attorney, Agent, or Firm* — Nixon & Vanderhye, P.C.

(57) ABSTRACT

A turbomachine combustor includes a combustion chamber; a plurality of micro-mixer nozzles mounted to an end cover of the combustion chamber, each including a fuel supply pipe affixed to a nozzle body located within the combustion chamber, wherein fuel from the supply pipe mixes with air in the nozzle body prior to discharge into the combustion chamber; and wherein at least some of the nozzle bodies of the plurality of micro-mixer nozzles have axial length dimensions that differ from axial length dimensions of other of the nozzle bodies.

20 Claims, 4 Drawing Sheets

(56) References Cited

U.S. PATENT DOCUMENTS

| | | | | |
|---|---|---|---|---|
| 7,007,478 | B2 * | 3/2006 | Dinu | 60/737 |
| 7,093,438 | B2 | 8/2006 | Dinu et al. | |
| 7,107,772 | B2 | 9/2006 | Chen et al. | |
| 7,117,677 | B2 * | 10/2006 | Inoue et al. | 60/737 |
| 7,509,808 | B2 | 3/2009 | Storey et al. | |
| 7,578,130 | B1 * | 8/2009 | Kraemer et al. | 60/737 |
| 8,261,555 | B2 | 9/2012 | Uhm et al. | |
| 8,322,143 | B2 | 12/2012 | Uhm et al. | |
| 8,733,108 | B2 | 5/2014 | Kim et al. | |
| 2006/0096294 | A1 | 5/2006 | Farhangi et al. | |
| 2008/0072605 | A1 | 3/2008 | Hagen et al. | |
| 2008/0245337 | A1 | 10/2008 | Bandaru et al. | |
| 2008/0268387 | A1 | 10/2008 | Saito et al. | |
| 2009/0061369 | A1 | 3/2009 | Wang et al. | |
| 2009/0077972 | A1 | 3/2009 | Singh | |
| 2009/0178414 | A1 * | 7/2009 | Atassi | 60/765 |
| 2010/0008179 | A1 | 1/2010 | Lacy et al. | |
| 2010/0192577 | A1 | 8/2010 | Singh et al. | |
| 2010/0192578 | A1 * | 8/2010 | Singh et al. | 60/737 |
| 2010/0218501 | A1 | 9/2010 | York et al. | |
| 2010/0275603 | A1 * | 11/2010 | Saito et al. | 60/737 |
| 2012/0180487 | A1 * | 7/2012 | Uhm et al. | 60/737 |

OTHER PUBLICATIONS

U.S. Appl. No. 12/855,801, filed Aug. 13, 2010 (pending).

* cited by examiner

FIG. 1
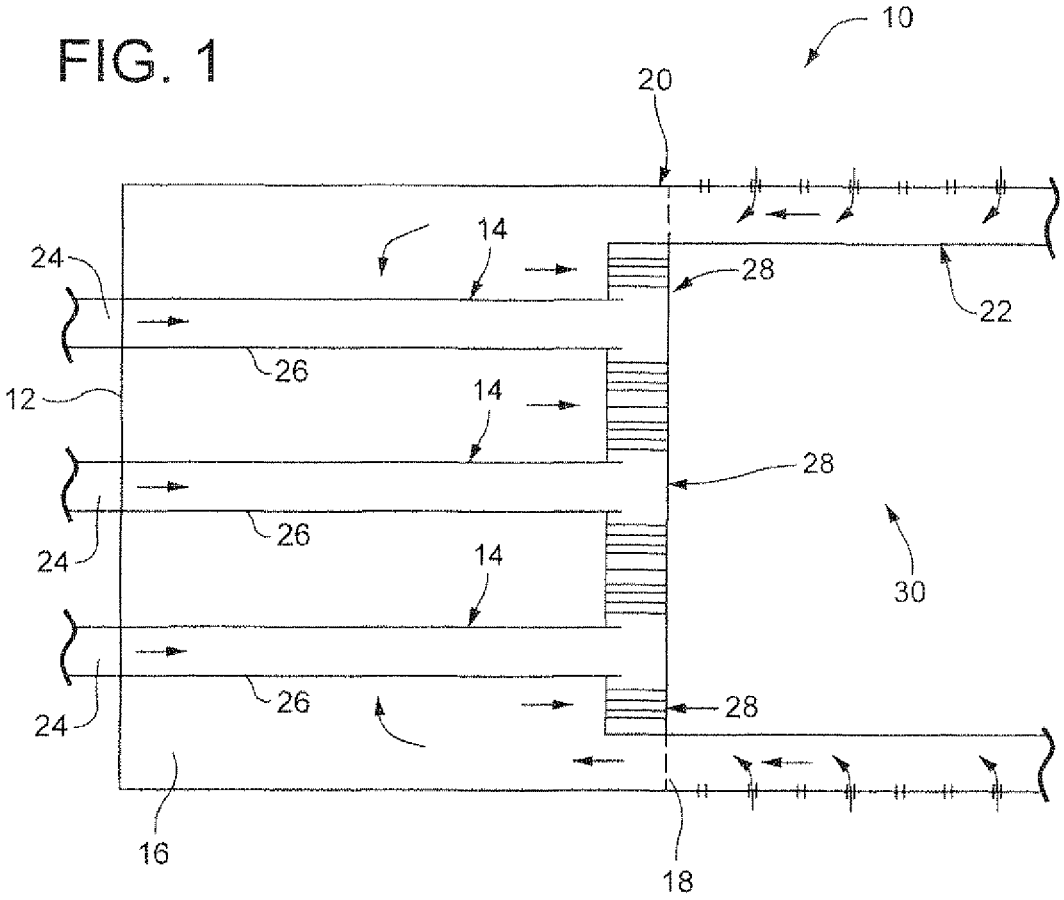
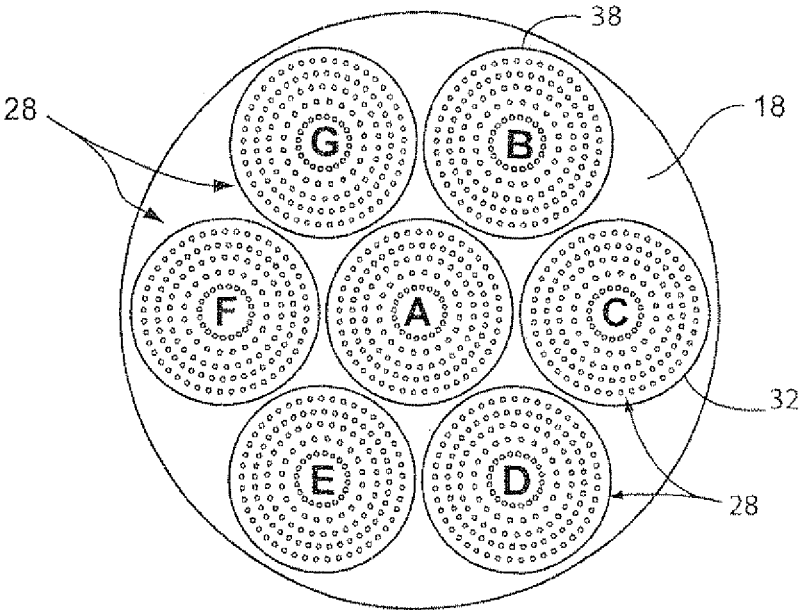
FIG. 2

TURBINE COMBUSTOR CONFIGURED FOR HIGH-FREQUENCY DYNAMICS MITIGATION AND RELATED METHOD

This invention was made with Government support under contract number DE-FC26-05NT42643 awarded by the Department of Energy. Accordingly, the Government has certain rights in this invention.

BACKGROUND

This invention relates generally to gas turbine combustion technology and, more specifically, to a fuel injection micro-mixer nozzle arrangement designed for high concentration of hydrogen fuel combustion and high frequency-dynamic-tone mitigation.

BACKGROUND OF THE INVENTION

Combustion instability/dynamics is a phenomenon in turbomachines utilizing lean pre-mixed combustion. Depending on the nature of the excitation of combustion chamber modes, combustion instability can be caused by high or low frequency dynamic fields. A low frequency combustion dynamics field is typically caused by excitation of axial modes, whereas a high frequency dynamic field is generally caused by the excitation of radial, azimuthal and axial modes by the combustion process, commonly referred to as "screech". The high-frequency dynamic field includes all combustor components that are involved in combustion. Under certain operating conditions, the combustion component and the acoustic component couple to create a high and/or low frequency dynamic field that has a negative impact on various turbomachine components with a potential for hardware damage. The dynamic field passing from the combustor may also excite modes of downstream turbomachine components that can lead to damage to those parts.

It is known, for example, that high hydrogen and nitrogen in the gas turbine fuel with certain fuel/air ratios from the fuel nozzles can lead to high-amplitude screech tone dynamics greater than 1.0 kHz in frequency. This kind of high frequency tone can transfer strong vibrational energy to combustor components that can result in hardware damage.

To address this problem, turbomachines may be operated at less than optimum levels, i.e., certain operating conditions are avoided in order to avoid circumstances that are conducive to combustion instability. While effective at suppressing combustion instability, avoiding these operating conditions restricts the overall operating envelope of the turbomachine.

Another approach to the problem of combustion instability is to modify combustor input conditions. More specifically, fluctuations in the fuel-air ratio are known to cause combustion dynamics that lead to combustion instability. Creating perturbations in the fuel-air mixture by changing fuel flow rate can disengage the combustion field from the acoustic field to suppress combustion instability.

While both of the above approaches are effective at suppressing combustion instability, avoiding various operating conditions restricts an overall operating envelope of the turbomachine, and manipulating the fuel-air ratio requires a complex control scheme, and may lead to less than efficient combustion.

BRIEF SUMMARY OF THE INVENTION

In accordance with an exemplary but nonlimiting embodiment, the present invention relates to a turbomachine combustor comprising a combustion chamber; a plurality of micro-mixer nozzles mounted to an end cover of the combustion chamber, each micro-mixer nozzle including a fuel supply pipe affixed to a nozzle body located within the combustion chamber, each nozzle body comprising a substantially hollow body formed with an upstream end face, a downstream end face and a peripheral wall extending therebetween, wherein each substantially hollow body is provided with a plurality of pre-mix tubes or passages extending axially through the substantially hollow body, thereby permitting fuel from the supply pipe to mix with air in the nozzle body prior to discharge into the combustion chamber; and wherein at least some nozzle bodies of the plurality of micro-mixer nozzles have axial length dimensions that differ from axial length dimensions of other of the nozzle bodies.

In accordance with another exemplary but nonlimiting embodiment, the invention relates to a turbomachine combustor comprising a combustion chamber; a plurality of nozzle bodies supported in the combustion chamber, and connected to respective fuel supply pipes, wherein fuel from the supply pipes mixes with air in the nozzle bodies prior to discharge into the combustion chamber; wherein the plurality of nozzle bodies comprise a center nozzle body and an annular array of radially outer nozzle bodies surrounding the center nozzle body, each of the plurality of nozzle bodies and the center nozzle body comprising a substantially hollow body formed with an upstream end face, a downstream end face and a peripheral wall extending therebetween, wherein each substantially hollow body is provided with a plurality of pre-mix tubes or passages extending axially through the substantially hollow body; the center nozzle body having a first axial length, and the annular array of radially outer nozzle bodies having at least second and third axial lengths that are different from the first axial length.

In still another aspect, the invention relates to a method of mitigating high frequency dynamics in a turbine combustor incorporating plural micro-mixer nozzles arranged substantially in parallel, each micro-mixer nozzle having a nozzle body at an aft end thereof, the method comprising arranging the plural micro-mixer nozzles in an array of radially outer micro-mixer nozzles surrounding a center micro-mixer nozzle; each of the radially outer micro-mixer nozzle bodies and the center micro-mixer nozzle body comprising a substantially hollow body formed with an upstream end face, a downstream end face and a peripheral wall extending therebetween, with a plurality of pre-mix tubes or passages extending axially through the substantially hollow body; and forming at least some of the plural micro-mixer nozzles to have nozzle bodies of respectively different axial length dimensions.

The invention will now be described in greater detail in connection with the drawings identified below.

BRIEF DESCRIPTION OF THE DRAWINGS

FIG. 1 is a partial, simplified schematic view of a combustor incorporating a plurality of micro-mixer nozzles in accordance with a first exemplary but nonlimiting embodiment;

FIG. 2 is a schematic aft-end view of the micro-mixer nozzles in the combustor of FIG. 1;

DETAILED DESCRIPTION OF THE DRAWINGS

Figure 3:
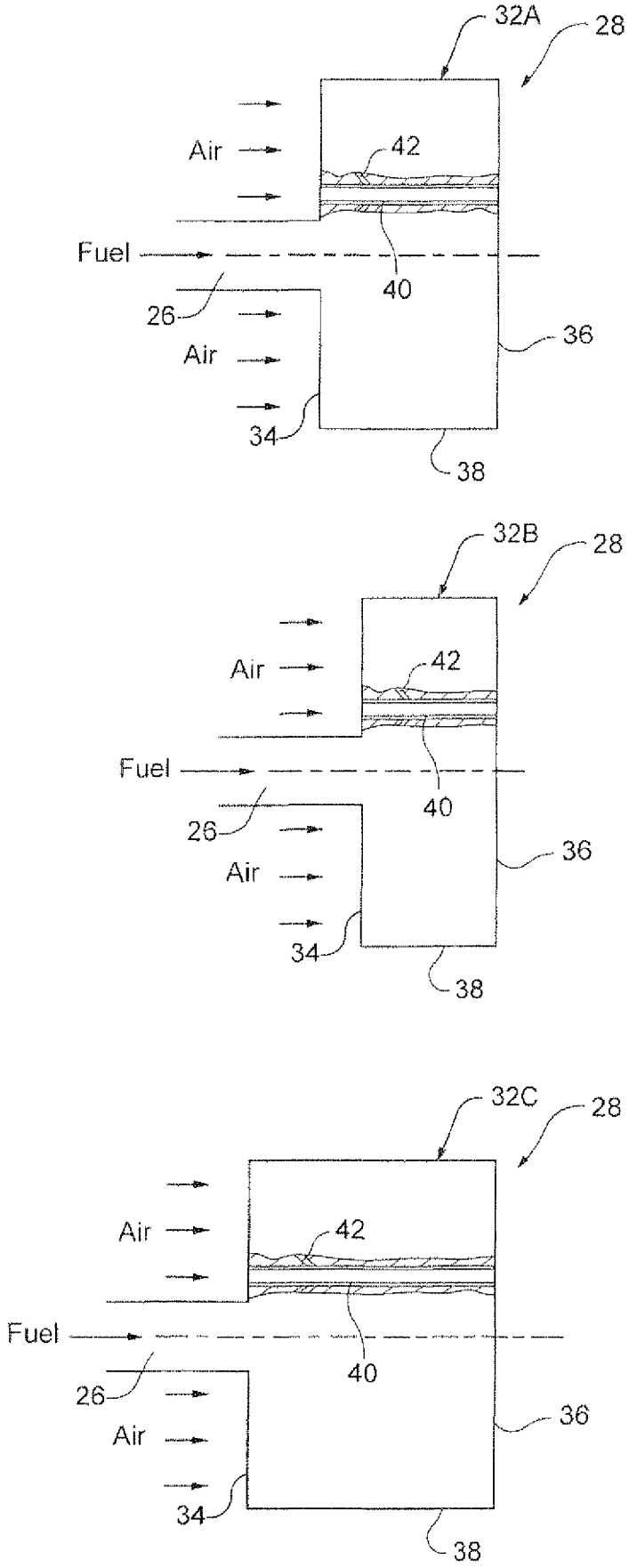
FIG. 3 is a partial side profile of the micro-mixer nozzle bodies utilized in the combustor of FIG. 1, illustrating exemplary differential lengths of the nozzle bodies.

With reference to FIG. 1, a gas turbine combustor 10 includes an end cover 12 that supports a plurality of micro-mixer fuel injection nozzles 14 extending through a chamber 16 between the end cover 12 and an aft cap assembly 18. A flow sleeve 20 surrounds the combustor liner 22 and provides a path for compressor air to flow in a direction opposite the flow of combustion gases through the combustor. The air supplied by the compressor is also used to cool the transition piece 24 (not shown) which supplies the hot combustion gases to the turbine first stage (not shown) adjacent the outlet end of the transition piece.

Fuel is supplied through the plumbed pipes 24, the end cover 12 and through the nozzle pipes 26 to the micro-mixer nozzle bodies 28 where the fuel mixes with air as described further herein, and is then injected into the combustion chamber 30 where the fuel is burned and then supplied in gaseous form to the turbine first stage via the transition piece. The nozzle bodies 28 are also supported at their aft ends by the aft cap assembly 18.

it will be appreciated that plural combustors 10 are typically arranged to supply a mixture of fuel and air to the respective combustion chambers. In a known turbine configuration, an annular array of such combustors (often referred to as a "can-annular" array) supply combustion gases to a first stage of the turbine by means of a like number of transition pieces or ducts.

With reference now also to FIGS. 2 and 3, the micro-mixer nozzle bodies 28 each may be formed as a substantially hollow, cylindrical body 32 A, B or C, each having an upstream end face 34 and an aft or downstream end face 36, substantially parallel to one another, with an annular peripheral wall 38 axially therebetween. Internal air supply passages or tubes 40 (also referred to as pre-mix tubes) extend between the upstream and downstream end faces 34, 36 and have a substantially uniform diameter from the upstream inlets through the downstream outlets, although the inlets may be flared outwardly (i.e., formed with a bell-mouth shape) to facilitate (and accelerate) the flow of air into and through the tubes. The pre-mix tubes 40 may be arranged in annular, concentric rows, with the pre-mix tubes of any given row circumferentially offset from the pre-mix tubes or passages of an adjacent row. It will be appreciated, however, that the invention is not limited by any specific arrangement of pre-mix tubes 40 within the hollow body 32.

The center region of the hollow body 32 is open at the forward or upstream end face, providing an inlet for receiving the fuel feed tube or pipe 26, such that fuel is supplied to the hollow body interior space surrounding the pre-mix tubes 40.

At least one, and preferably an array of fuel injection holes (schematically shown in FIGS. 3 and 4 at 42) is provided in each of the pre-mix tubes 40, e.g., four in each tube, at equally-spaced locations about the circumference of the respective tube. The fuel injection holes may be slanted in the direction of flow, i.e., the holes may be angled radially inwardly (at low acute angles, for example 30°, relative to the centerline of the respective pre-mix tube 40) in the downstream direction so that the flow of fuel through the injection holes has a velocity component in the direction of the air flowing through the pre-mix tubes 40. It will be understood, however, that the injection holes 42 may extend at any angle between 15° and substantially 90° relative to the longitudinal axes of the pre-mix tubes. Additional details relating to the nozzle construction may be found in, for example, commonly-owned U.S. Published Application No. US2010/0218510 A1.

The high-hydrogen fuel will flow through the fuel injection holes 42 and into the pre-mix tubes 40 where the fuel and air mix before exiting the nozzle body 32 at the aft end face 36 into the combustion chamber 30.

In accordance with an exemplary but nonlimiting embodiment, it has been determined that high frequency-dynamic-tone or high screech mitigation can be achieved by changing the axial length dimension of the micro-mixers nozzle bodies 32. Specifically, in one exemplary but nonlimiting embodiment (FIGS. 1-3), an annular array of six micro-mixer nozzle bodies surround a center micro-mixer nozzle body. All of the micro-mixer nozzle bodies 32 are aligned substantially in the same plane at their respective outlet ends, best seen in FIGS. 1 and 3 and consistent with the nozzle body orientation in FIG. 1, with cap assembly 18 substantially defining the singe plane. The inlet ends to the nozzle bodies, however, do not lie in a single plane, and it is here that the differential length dimensions are implemented. In FIG. 2, the micro-mixer nozzle bodies 32A, 32B and 32C are assigned certain locations in the radially outer array and in the center of the array. For example, nozzle body 32A may be used in the center, at location A; and nozzle bodies 32B and 32C may be used in various combinations at the radially outer nozzle locations B-G. For example, nozzle bodies 32B and 32C may be arranged in alternating fashion. While three differential length bodies 32A, 32B and 32C are illustrated, it will be appreciated that the six nozzle bodies in the outer array may have six different axial lengths, and the center nozzle body may have one of those six axial lengths or a different, seventh axial length, shorter or longer than the outer nozzle bodies.

Essentially, any combination of different lengths may be employed, but it is important to avoid certain relative length relationships, specifically, lengths that are ½ or 2× another length. This is because at ½ or 2× length, vibrations will occur in harmonics and sub-harmonics of fundamental waves, respectively, with little or no screech mitigation. It is also preferable that any two adjacent outer nozzle bodies not have the same length.

Figure 4:
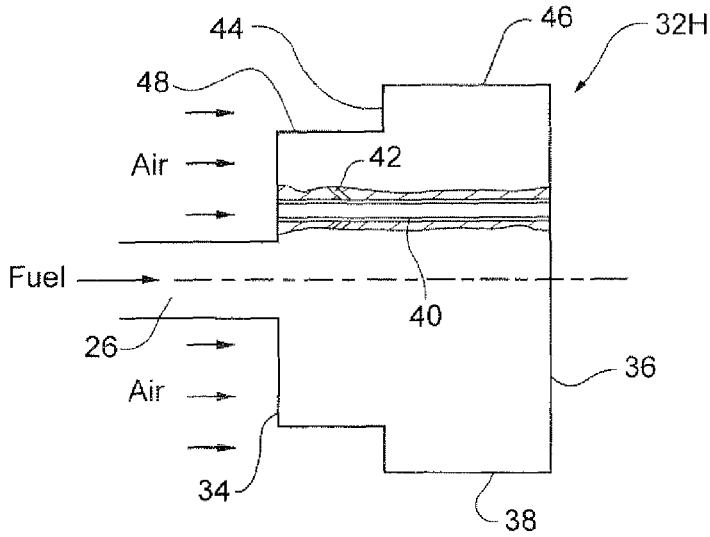
FIG. 4 is a partial side profile of micro-mixer nozzle body configurations in accordance with other exemplary but nonlimiting embodiments.
Figure 4:
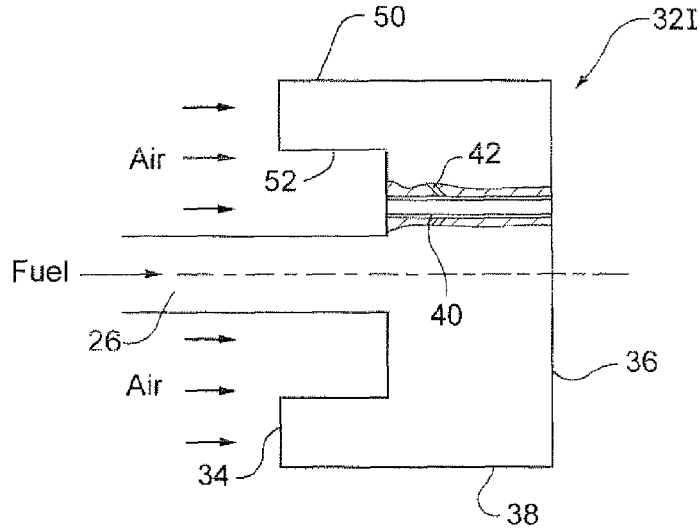

Turning to FIG. 4, alternative micro-mixer nozzle bodies 32H and 32I are illustrated where stepped configurations at the forward ends of the nozzle bodies are provided. Nozzle body 32H is formed with a step or shoulder 44 on the upstream side such that a first aft portion 46 of the nozzle body has an outer diameter greater than a forward portion 48, such that the axial length of the premix tubes 40 in the aft or radially outer portion 46 of the nozzle body is less than the axial length of the premix tubes in the forward or radially inner portion 48 of the nozzle body. Stated otherwise, the nozzle body 32H has differential length dimensions integrated therein. It will be appreciated that multiple steps or shoulders may be incorporated into the upstream end of the nozzle body.

Nozzle body 32I is reversed relative to nozzle body 32H in that the axial length of the radially outer portion 50 is greater than the radially inner portion 52 such that pre-mix tubes in the radially outer portion 50 have axial length dimensions greater than axial lengths of pre-mix tubes in the radially inner portion 52. Here again, multiple steps or shoulders may be incorporated into the upstream end of the nozzle body, and multiple combinations of the nozzle bodies 32D and E are possible. For example, nozzle bodies 32D and/or 32E may be used with one or more of nozzle bodies 32A-C consistent with the caveats noted above.

Figure 5:
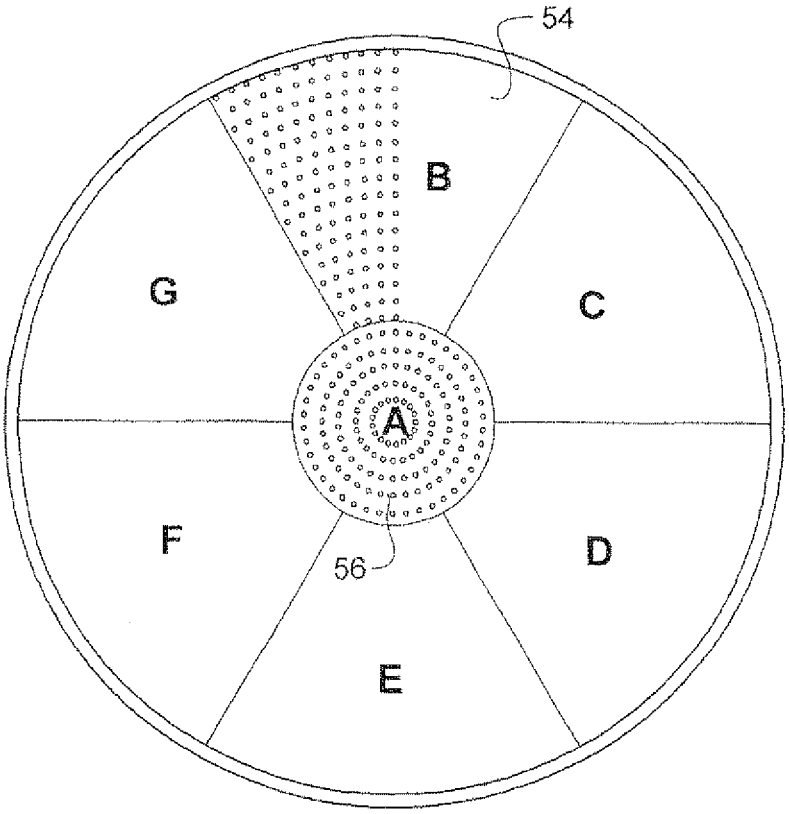
FIG. 5 is a schematic aft-end view of an alternative configuration for micro-mixer nozzles to which the invention described herein is applicable.

It will be appreciated that other micro-mixer nozzle body designs that incorporate differential axial length dimensions or patterns are within the scope of the invention. For example, FIG. 5 is a schematic aft-end view of an alternative configuration for micro-mixer nozzles to which the invention described herein is applicable. Here, the nozzle bodies 54 at locations B-G are "sector-shaped", while the center nozzle body 56 at location A remains round as in FIGS. 1-4. Otherwise, the differentiated lengths as described in connection with FIGS. 3 and 4 are fully applicable to the sector-shaped nozzle bodies. It will be appreciated that the other nozzle body shapes may be employed as well.

While the invention has been described in connection with what is presently considered to be the most practical and preferred embodiment, it is to be understood that the invention is not to be limited to the disclosed embodiment, but on the contrary, is intended to cover various modifications and equivalent arrangements.

We claim:

1. A turbomachine combustor comprising:

a combustion chamber;

a plurality of micro-mixer nozzles mounted to an end cover of the combustion chamber, each micro-mixer nozzle including a fuel supply pipe affixed to a nozzle body located within the combustion chamber, each nozzle body comprising a substantially hollow body formed with an upstream end face, a downstream end face and a peripheral wall extending therebetween, wherein each substantially hollow body is greater in diameter than its respective fuel supply pipe, receives fuel from the respective fuel supply pipe, and is provided with a plurality of pre-mix tubes or passages extending axially through said substantially hollow body, thereby permitting fuel from the supply pipe to mix with air in said nozzle body prior to discharge into said combustion chamber; and wherein at least some nozzle bodies of said plurality of micro-mixer nozzles have axial length dimensions that differ from axial length dimensions of other of said nozzle bodies along an inlet end of the nozzle bodies.

2. The turbomachine combustor of claim 1 wherein said plurality of micro-mixer nozzles comprise a center nozzle and an annular array of radially outer nozzles surrounding said center nozzle.

3. The turbomachine combustor of claim 2 wherein every other nozzle body of said annular array of radially outer nozzles has a first axial length dimension, and wherein remaining nozzle bodies of said annular array of said radially outer nozzles have a second axial length dimension greater or less than said first axial length dimension.

4. The turbomachine combustor of claim 3 wherein the nozzle body of said center nozzle has an axial length dimension equal to, or different than said first and second axial length dimensions.

5. The turbomachine combustor of claim 1 wherein none of said axial length dimensions of said plurality of micro-mixer nozzle bodies are the same.

6. The turbomachine of claim 1 wherein said nozzle body of one or more of said plurality of micro-mixer nozzles is formed to include a radially outer portion of a first diameter, and at least one radially inner portion of a second diameter less than said first diameter, connected by a radially-oriented shoulder, and wherein said radially outer and radially inner portions have differential axial lengths.

7. The turbomachine of claim 6 wherein pre-mix tubes in said radially outer portion have axial length dimensions less than axial length dimension of pre-mix tubes in said at least one radially inner portion.

8. The turbomachine of claim 7 wherein pre-mix tubes in said radially outer portion have axial length dimensions greater than axial length dimensions of pre-mix tubes in said at least one radially inner portion.

9. A turbomachine combustor comprising:

a combustion chamber;

a plurality of nozzle bodies supported in said combustion chamber, and connected to respective fuel supply pipes, wherein fuel from said supply pipes mixes with air in said nozzle bodies prior to discharge into said combustion chamber; wherein said plurality of nozzle bodies comprise a center nozzle body and an annular array of radially outer nozzle bodies surrounding said center nozzle body, each of said plurality of nozzle bodies and said center nozzle body comprising a substantially hollow body greater in diameter than its respective fuel supply pipe, the hollow body receives fuel from the respective fuel supply pipe, and the hollow body is formed with an upstream end face, a downstream end face and a peripheral wall extending therebetween, wherein each substantially hollow body is provided with a plurality of pre-mix tubes or passages extending axially through said substantially hollow body; said center nozzle body having a first axial length, and said annular array of radially outer nozzle bodies having at least second and third axial lengths that are different from said first axial length along an inlet end of the nozzle bodies.

10. The turbomachine of claim 9 wherein axial length dimensions differ for each of said plurality of nozzle bodies.

11. The turbomachine of claim 9 wherein no adjacent nozzle bodies of said plurality of nozzle bodies have identical axial lengths.

12. A method of mitigating high frequency dynamics in a turbine combustor incorporating plural micro-mixer nozzles arranged substantially in parallel, each micro-mixer nozzle having a nozzle body at an aft end thereof, the method comprising:

a. arranging said plural micro-mixer nozzles in an array of radially outer micro-mixer nozzle bodies surrounding a center micro-mixer nozzle body, each of said radially outer micro-mixer nozzle bodies and said center micro-mixer nozzle body comprising a substantially hollow body greater in diameter than a respective fuel supply pipe, the hollow body receiving fuel from the respective fuel supply pipe, and the hollow body is formed with an upstream end face, a downstream end face and a peripheral wall extending therebetween, with a plurality of pre-mix tubes or passages extending axially through said substantially hollow body; and b. forming at least some of said plural micro-mixer nozzles to have nozzle bodies of respectively different axial length dimensions along an inlet end of the nozzle bodies.

13. The method of claim 12 wherein step b. includes forming every other nozzle body of said array of radially outer micro-mixer nozzles to have a first axial length dimension, and forming remaining nozzle bodies of said array of radially outer micro-mixer nozzles to have a second axial length dimension greater to or less than said first axial length dimension.

14. The method of claim 13 wherein step b. includes forming said center nozzle to have a nozzle body with a third axial length dimension different from first and second axial length dimensions.

15. The method of claim 12 wherein axial length dimensions differ for each of said plurality of micro-mixer nozzles.

16. The method of claim 12 wherein said nozzle body of one or more of said plurality of micro-mixer nozzles is formed to include at least first and second axially-extending portions connected by a shoulder, such that said at least first and second axially-extending portions have differential axial lengths.

17. The method of claim 16 wherein a radially outer one of said at least first and second axially-extending portions has an axial length dimension less than an axial length dimension of a radially inner one of said at least first and second axially-extending portions.

18. The method of claim 16 wherein a radially outer one of said at least first and second axially-extending portions has an axial length dimension greater than an axial length dimension of a radially inner one of said at least first and second axially-extending portions.

19. The method of claim 12 wherein no adjacent nozzle bodies of said plurality of nozzle bodies have identical axial lengths.

20. The method of claim 12 wherein each radially outer micro-mixer nozzle body in said array of radially outer micro-mixer nozzle bodies is sector-shaped, and said center micro-mixer nozzle body is round.

* * * * *